United States Patent [19]

Sakamura et al.

[11] Patent Number: 4,966,028

[45] Date of Patent: Oct. 30, 1990

[54] MULTI-STAGE COLD FORGING MACHINE

[75] Inventors: Yoshikazu Sakamura, Uehonmachi; Sumitada Higuchi, Motokurihashi, both of Japan

[73] Assignee: Kabushiki Kaisha Sakamurakikai Seisakusho, Osaka, Japan

[21] Appl. No.: 270,691

[22] Filed: Nov. 14, 1988

[51] Int. Cl.[5] ..... B21J 13/10

[52] U.S. Cl. ..... 72/361; 72/405

[58] Field of Search ..... 10/11 T, 76 T; 72/345, 72/356, 361, 405

[56] References Cited

U.S. PATENT DOCUMENTS

| | | | |
|---|---|---|---|
| 2,687,660 | 8/1954 | Friedman | 10/76 T |
| 3,452,582 | 7/1969 | Faymonville | 72/405 |
| 3,834,213 | 9/1974 | Henzler et al. | 72/405 |

*Primary Examiner*—Lowell A. Larson

*Attorney, Agent, or Firm*—Barnes & Thornburg

[57] ABSTRACT

A multi-stage cold forging machine including a parts forming aid unit, which has a number of aid pins corresponding to that of the forging dies, the pins being adapted to retain a forged blank against a knockout pin slidably housed in the dies, and transfer it from the respective stage to the next. The blank is progressively refined as it is transferred from stage to stage. The aid pins are operated in such a manner as to stand out of the way of the hammers moved by a ram.

1 Claim, 11 Drawing Sheets

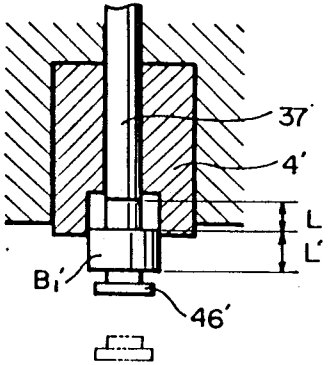
FIG.6
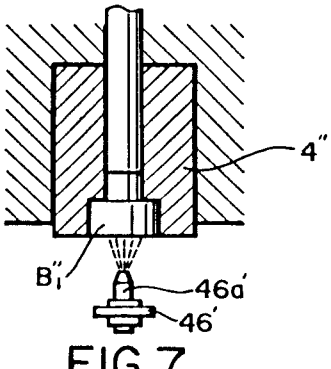
FIG.7
FIG.5(I)
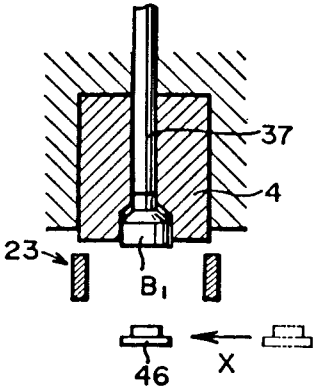
FIG.5(II)
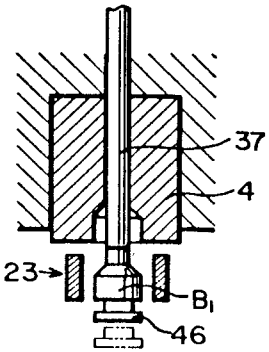
FIG.5(III)
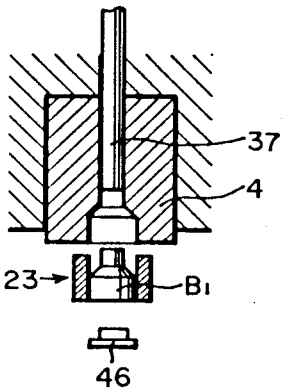

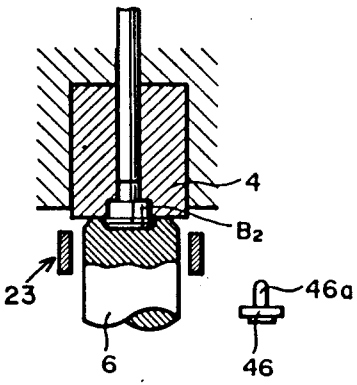
FIG.9(III)

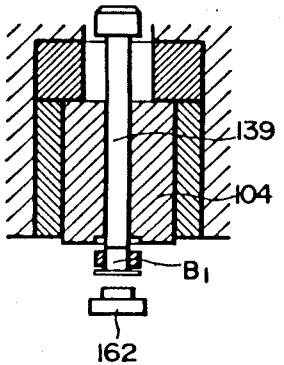
FIG. 13(III)

MULTI-STAGE COLD FORGING MACHINE

BACKGROUND AND SUMMARY OF THE INVENTION

The present invention relates to a multi stage cold forging machine, and more particularly, to a cold forging machine which forms metal parts such as bolts through a series of stages, wherein the machine includes a device (hereinafter called a parts forming aid unit) for aiding small parts, such as bolts having short shanks, to be stably clamped by chucks.

A multi stage forging machine is known in the art, which forms metal parts progressively as a blank is transferred from stage to stage. The machine employs chucks for clamping a blank and transferring it from one die to the next. At each stage the blank is pushed out of the die by a knockout pin which moves synchronously with the withdrawal of the forging hammers.

The known multi-stage forging machine encounters a problem when small parts (i.e. ones having short shanks) are forged. Now, referring to FIG. 10, the problem will be explained:

FIG. 10 shows two cases (I) and (II) where a long bolt ($a_1$) and a small bolt ($a_2$) are forged, respectively. The small bolt ($a_2$) has a short shank ($a_2$) as compared with its head. The small bolt ($a_2$) is pushed out of the die by a knockout pin (c) more quickly than the long bolt ($a_1$), so that the chuck (d) must quickly catch the small bolt ($a_2$). Otherwise, it would slip out of the die. In contrast, the long bolt ($a_1$) takes a longer time before it comes out of the die (b), thereby enabling the chuck (d) to have sufficient time to catch the bolt ($a_1$). When the forging metal parts are small, the chucks have the difficulty of transferring them from stage to stage.

The present invention is directed toward a multi-stage cold forging machine which solves the problems discussed above with respect to the known multi-stage cold forging machines. Thus an object of the present invention is to provide an improved multi-stage cold forging machine capable of forming metal parts of any size without breaking the continuity of processes throughout the series of stages.

The object of the present invention is achieved by providing a multi-stage cold forging machine including a parts forming aid unit, the aid unit having a number of aid pins corresponding to that of the forging dies, the pins being adapted to retain a blank against a knockout pin slidable in the dies, and transfer it from one stage to the next, wherein the aid pins are operated in such a manner as to stand out of the way of the forging hammers moved by a ram. Thus the blank is progressively refined as it is transferred from stage to stage.

Other objects and advantages of the present invention will become more apparent from the following detailed description, when taken in conjunction with the accompanying drawings which show, for the purpose of illustration only, one embodiment in accordance with the present invention.

BRIEF DESCRIPTION OF THE DRAWINGS

FIGS. 5(I), (II) and (III), are schematic views showing the relationship among the knockout pin, the chuck, the aid pin, and the blank;

FIGS. 6 and 7 are schematic views showing examples of modified versions;

DETAILED DESCRIPTION OF THE INVENTION

Figure 1:
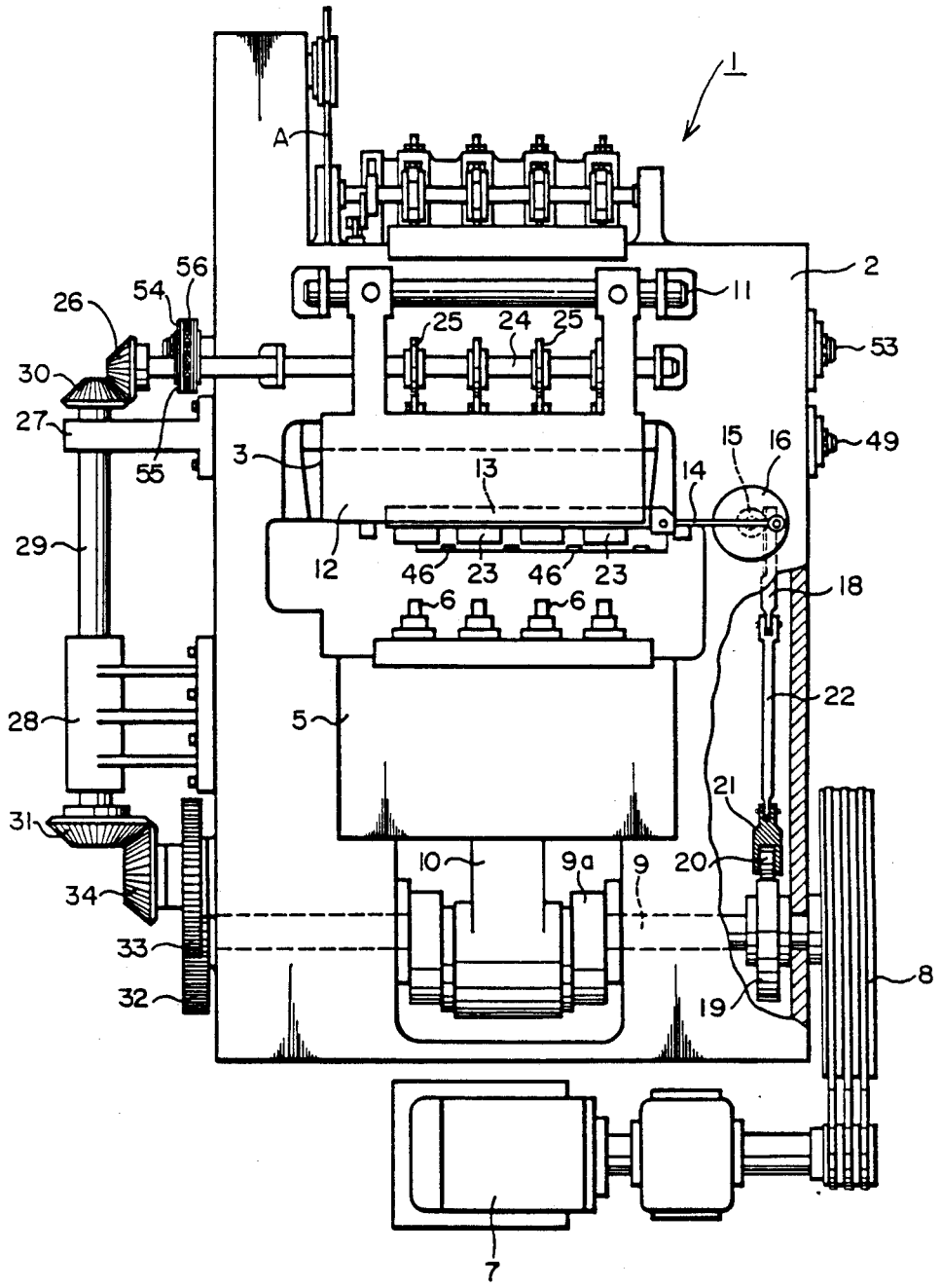
FIG. 1 is a plan view showing a multi-stage cold forging machine incorporating a parts forming aid unit according to present invention.

Referring to FIG. 1, the forging machine is generally denoted by the reference numeral 1. The forging machine 1 has a bed 2 on which a die block 3 is mounted. The die block 3 carries a plurality of dies 4 (four dies in the illustrated embodiment) spaced at equal intervals A die and a hammer 6 constitute a stage. At the first stage a metal blank is roughly formed to a desired shape, and as it is transferred from stage to stage, the shape is progressively refined. The hammers 6 are carried on a ram 5. The die and hammer are operated in cooperation with each other. The ram 5 is connected to a crank arm 9*a* of a crankshaft 9 fixed to a flywheel 8 driven by an electric motor 7. The reference numeral 10 denotes a connecting rod. In this way the ram 5 is reciprocally moved to and from the die block 3 by the motor 7, whereby the hammers 6 are also reciprocated to and from the dies 4.

Figure 2:
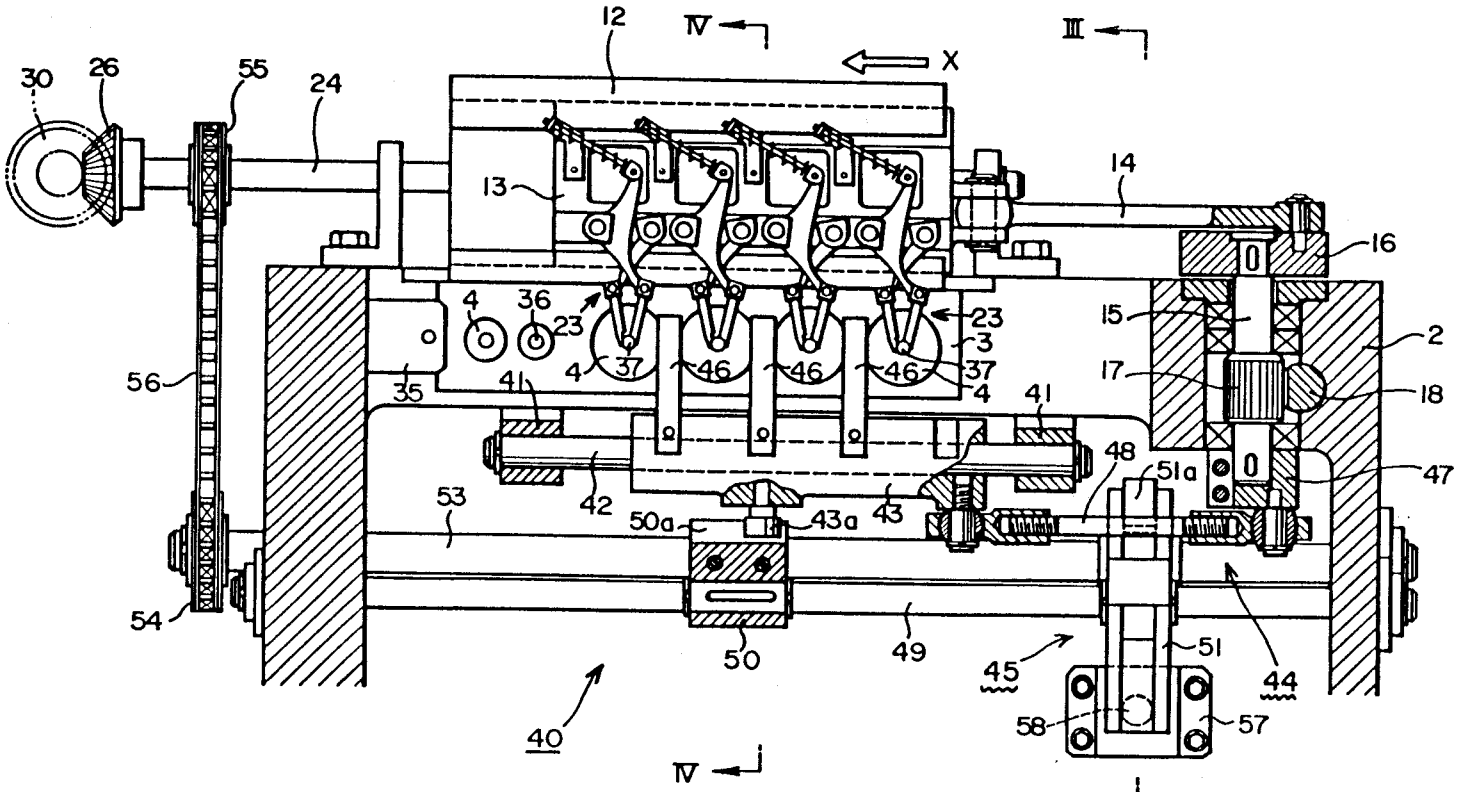
FIG. 2 is a front view on an larger scale showing the parts forming aid unit of FIG. 1.
Figure 3:
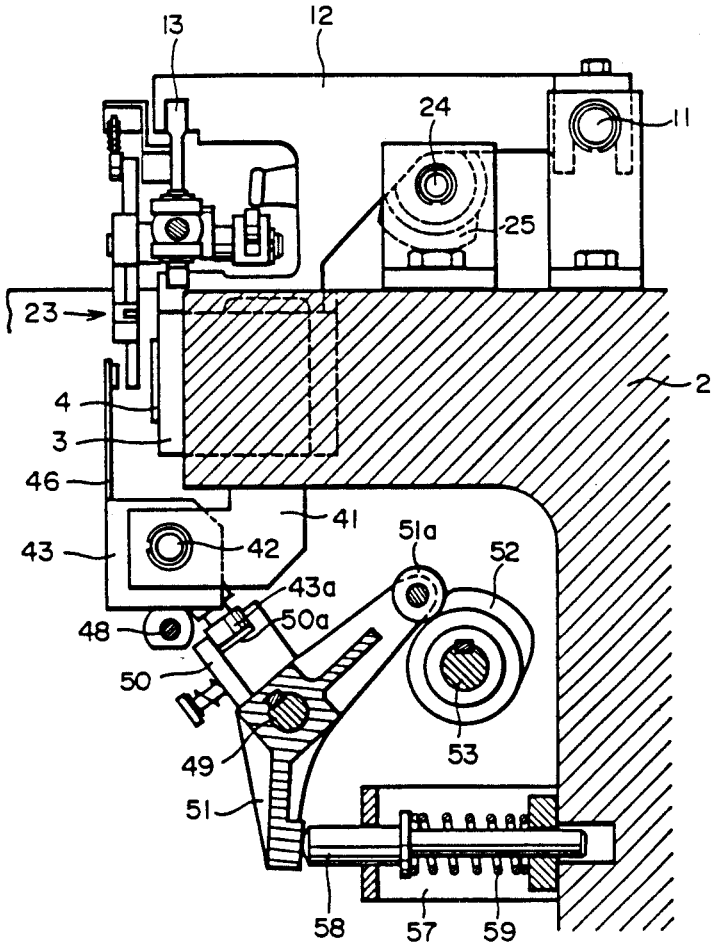
FIGS. 3 and 4 are cross-sectional views taken along the lines III—III and IV—IV in FIG. 2, respectively.
Figure 4:
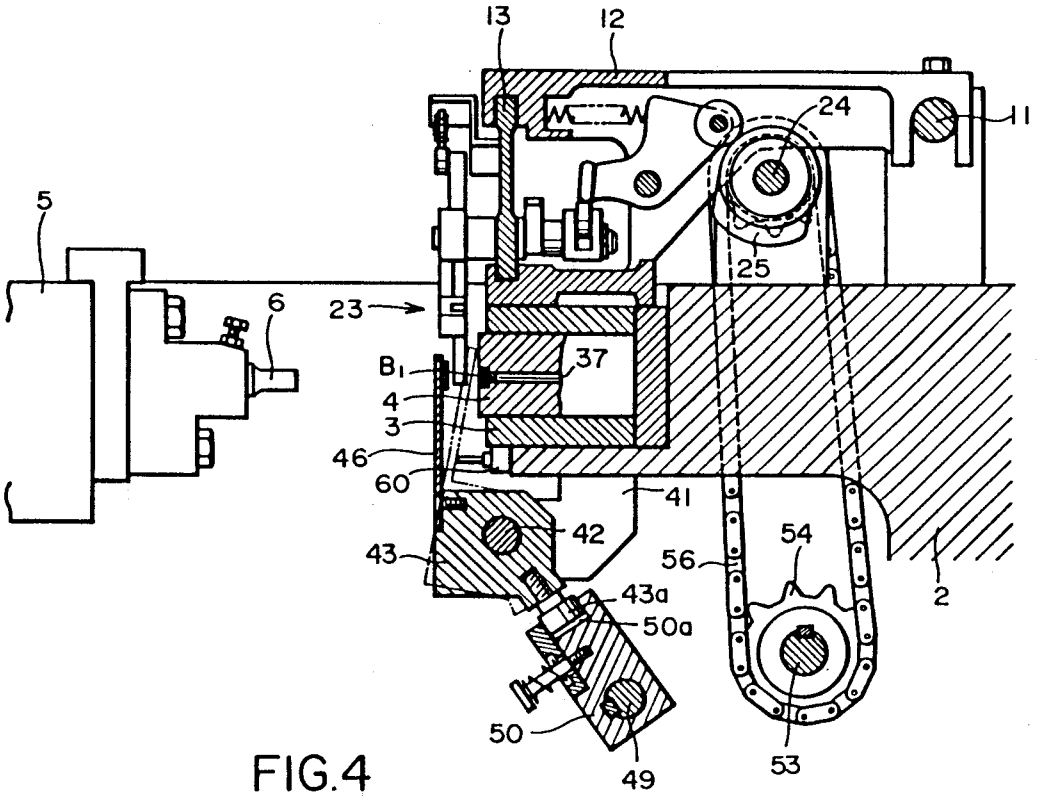

As best shown in FIGS. 3 and 4, the machine 1 is provided with a chuck holder 13 supported by a supporting frame 12, which is carried on a shaft 11 at its rear end. The front end of the supporting frame 12 rests on the die block 3. The shaft 11 is mounted on the bed 2. The chuck holder 13 is connected to a connecting rod 14, which, as shown in FIG. 2, is connected to a chuck driving shaft 15 through a junction 18. The chuck driving shaft 15 is provided with a pinion 17, which is in engagement with a rack 18 connected to an intermediate lever 22. As shown in FIG. 1, the intermediate lever 22 is connected to a swing arm 21, which is swingeable by a cam 19 fixed to the crankshaft 9 through a roller 20. The swing arm 21 moves vertically in FIG. 1, thereby enabling the chuck driving shaft 15 to move reciprocally in a predetermined range. In this way, when the crankshaft 9 drives the ram 5, the chuck holder 13 synchronously moves. While the ram 5 moves by a single stroke (forward and backward), the chuck holder 13 moves along the row of dies 4 by a distance between one die 4 and the next.

The chuck holder 13 carries a number of paired chucks 23 corresponding to that of the dies 4, the chucks being located at the same intervals as those between the dies 4. The chucks 23 are designed to clamp a blank for transferring same from one stage to the next. The paired chucks 23 are opened and closed by means of a chuck operating shaft 24 through cams 25, the chuck operating shaft 24 being rotatively provided on the bed 2 in parallel with the shaft 11. The chuck operating shaft 24 is provided with a bevel gear 28, which is in engagement with a second bevel gear 30 of an intermediate shaft 29. The intermediate shaft 20 is provided with a third bevel gear 31 at the other end, which is in engagement with a fourth bevel gear 34 at the crankshaft side. The fourth bevel gear 34 is rotated by the crankshaft 9 through gears 32 and 33. Under this arrangement the chuck operating shaft 24 is rotated in accordance with the operation of the ram 5 such that a possible collision between the hammers 6 and the chucks 23 is avoided.

Referring to FIG. 2, there is provided a blank supplier 4a from which a blank (A) is supplied to the forging section where the dies 4 and the hammers 8 are operated. The blank (A) is cut by a cutter 36 to a desired length, and pushed by a pin 38 toward the die 4. Each die 4 is provided with a knockout pin 37 whereby the blank (A) is pushed out of the die 4 to enable the chuck 23 to clamp it.

Referring to FIGS. 2 to 4, a parts forming aid unit 40 (hereinafter called the aid unit) will be described:

The aid unit 40 includes a main shaft 42 supported on bearings 41 under the die block 3, a sliding block 43, a driving unit 44 for enabling the die block 3 to slide along the main shaft 42, a shaft rocking unit 45 for enabling the aid unit 40 to rock on the main shaft 42 in a clockwise and anti-clockwise direction in a predetermined angular range, and a plurality of aid pins 46 spaced at the same intervals as that between the dies 4, the aid pins 46 being fixed to the sliding block 43. The driving unit 44 includes a rod 48 whose one end is secured to a connecting member 47 fixed to a lower end of the chuck driving shaft 15 while the other end is kept in contact with a cam 52.

The aid unit 40 is operated as follows:

When the ram 5 is withdrawn with the hammers 6 being kept apart from the dies 4 (FIG. 1), the chucks 23 are opened in accordance with the rotation of the chuck operating shaft 24. The opened chucks 23 are moved to the right (in FIG. 2) in the direction of arrow (X) thereby enabling them to wait for a blank out of the die. At this moment the sliding block 43 is moved in the same direction (X), thereby enabling the aid pins 46 fixed to the sliding block 43 to locate in front of the respective dies 4 (FIG. 5(I)). The blank $B_1$ is pushed out of the die 4 by the knockout pin 37. At this moment the pin 46 is moved forward to keep contact with the blank $B_1$ and retain it as shown in FIG. 5(II). While the blank $B_1$ is retained by the pin 46, it is caught by the chuck 23. At this stage the sliding block 43 is slightly rotated, thereby moving the pin 46 backward until the blank $B_1$ is kept apart from the blank $B_1$ as shown in FIG. 5(III). Since the pin 46 is withdrawn, the chuck 23 holding the blank $B_1$ is shifted to the next stage without the possibility of collision with the pin 46. The driving unit 44 is again operated to return the pin 46 to its original position shown in FIG. 2 thereby enabling the pins 46 to stand out of the way of the hammers 6.

As is evident from the foregoing description, a small blank having a short shank (seen in FIG. 5) is safely caught by the chuck 23, and transported from one stage to the next. The pins 46 are operated without blocking the operation of the hammers 6 and the transfer of the blank $B_1$.

A modified version of the embodiment will be described by referring to FIG. 4:

This embodiment is characterized by the provision of a sensor 80 designed to detect if there occurs any abnormality such as the breakage of the knockout pin 37 in the die 4. The sensor 60 operates in response to the excessive decline of the pin 46 as shown by the imaginary lines in FIG. 4. The excessive decline may result from the failure of the blank $B_1$ to project through the die 4. The sensor 60 electrically signals so as to stop the operation of the machine 1.

FIG. 6 shows a case where the blank $B_1$ has a shorter shank (L) than the length (L') of the head. This type of blanks tend to drop as soon as it is released from the die 4 because of its heavy head and short shank. The aid unit 40 helps the blank $B_1$ to be safely clamped by the chuck 23 by causing the pin 46' to retain the top heavy blank $B_1'$.

FIG. 7 shows another example of the embodiment, characterized by the provision of a spray nozzle 48a' adapted to eject a lubricant over the top portion of the blank $B_1''$. Owing to the lubicant, the blank $B_1''$ accepts the hammer 6 at the next stage more easily.

Figure 8:
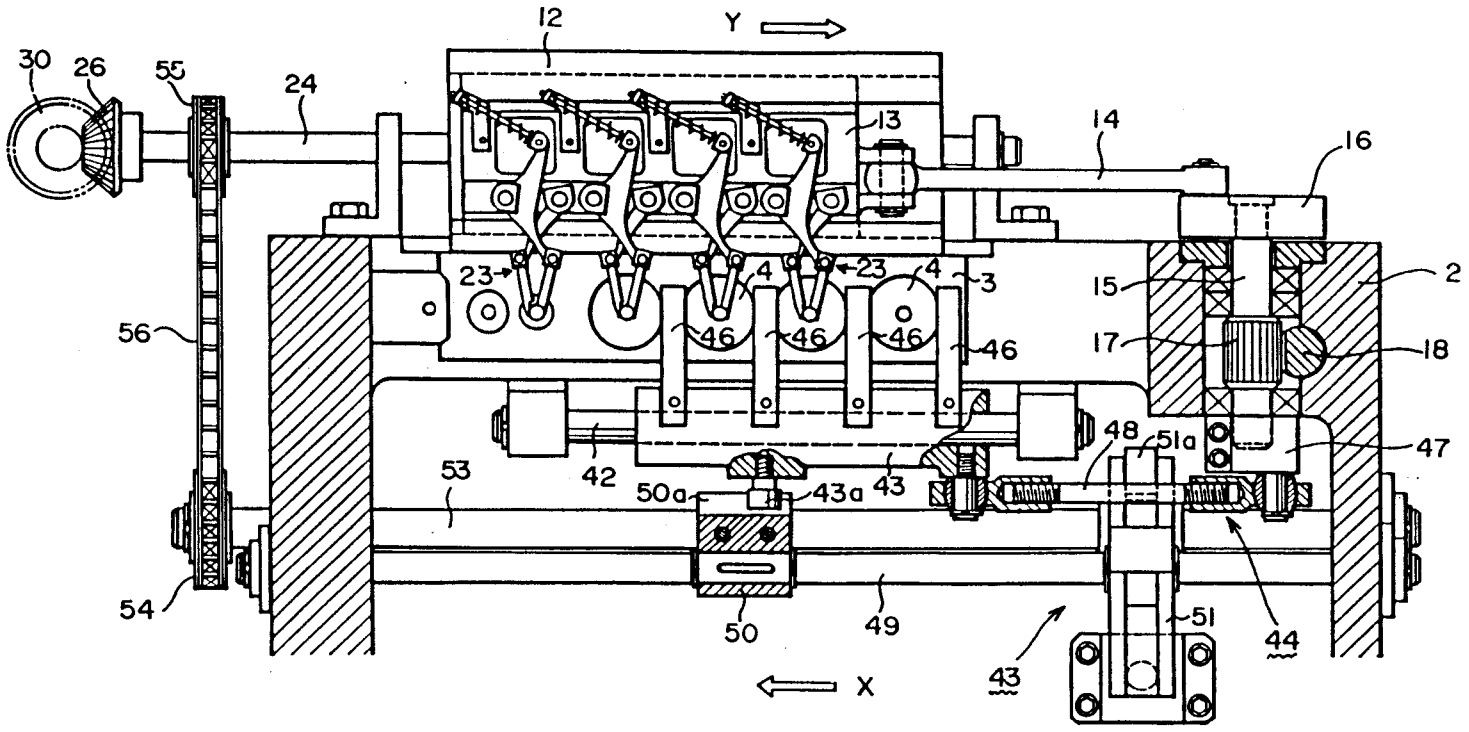
FIG. 8 is a front view showing an example of application in which the aid unit is employed as a blank inserter.
Figure 10I:
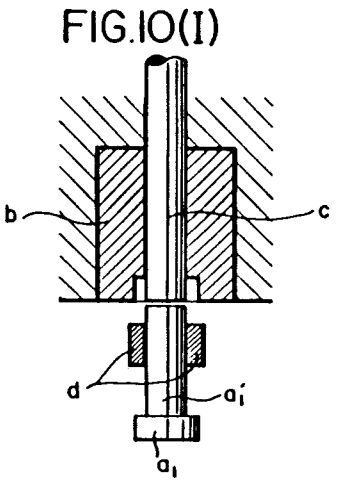
FIGS. 10(I) and (II) are schematic views showing the relationship among the knockout pin, the chuck, the aid pin, and the blank under the known forging machine.
Figure 10:
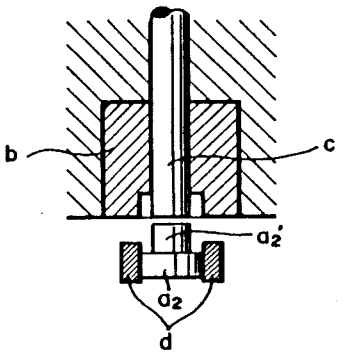
Figure 9:
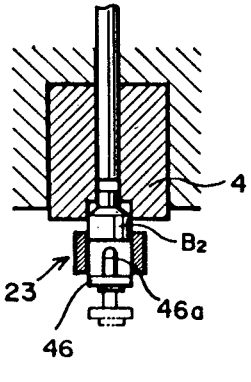
FIGS. 9(I), (II) and (III) are schematic views showing the relationship among the knockout pin, the chuck, the aid pin, and the blank in the example of FIG. 8.
Figure 9I:
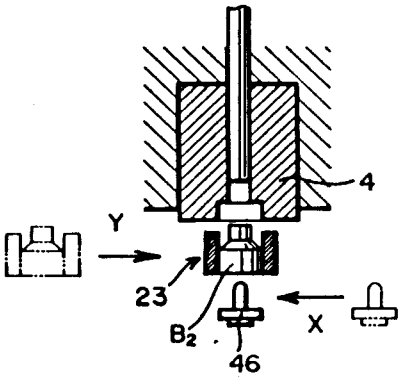

FIG. 8 shows a further example of the embodiment, characterized in that the aid unit 40 is used as a blank inserter. In the above-mentioned embodiment the aid unit 40 is to help the chuck to clamp a blank and transfer it from the stage to the next. The embodiment in FIG. 8 is to transfer a blank from one stage to the next, and insert it into the die. The states in which the connecting rod 14 and the intermediate rod 48 are connected to the chuck driving shaft 15 are differentiated by 180° from the above-mentioned aid unit 40 (FIG. 2). This modified version is operated as follows:

Synchronously with the advance of the ram 5 effected by the crankshaft 9, the chuck driving shaft 15 is rotated, thereby causing the chuck holder 13 to move in the direction of arrow (Y) (FIG. 8). In this way a blank $B_2$ clamped by the chuck 23 is transferred to the designated die 4 as shown in FIG. 9(I). At this moment the sliding block 43 advances in the direction of arrow (X), thereby causing the pin 46 to move until it positions immediately below the blank $B_2$ clamped by the chuck 23. At this stage the swinging member 50 is rotated so that the pin 46 is pushed to insert the blank $B_2$ into the die 4 (FIG. 9(II)), wherein the reference numeral 46a denotes an inserter head. Thus the blank $B_2$ is safely placed in the die 4 even if its shank is as short as to be difficult for the chuck to clamp.

Figure 11:
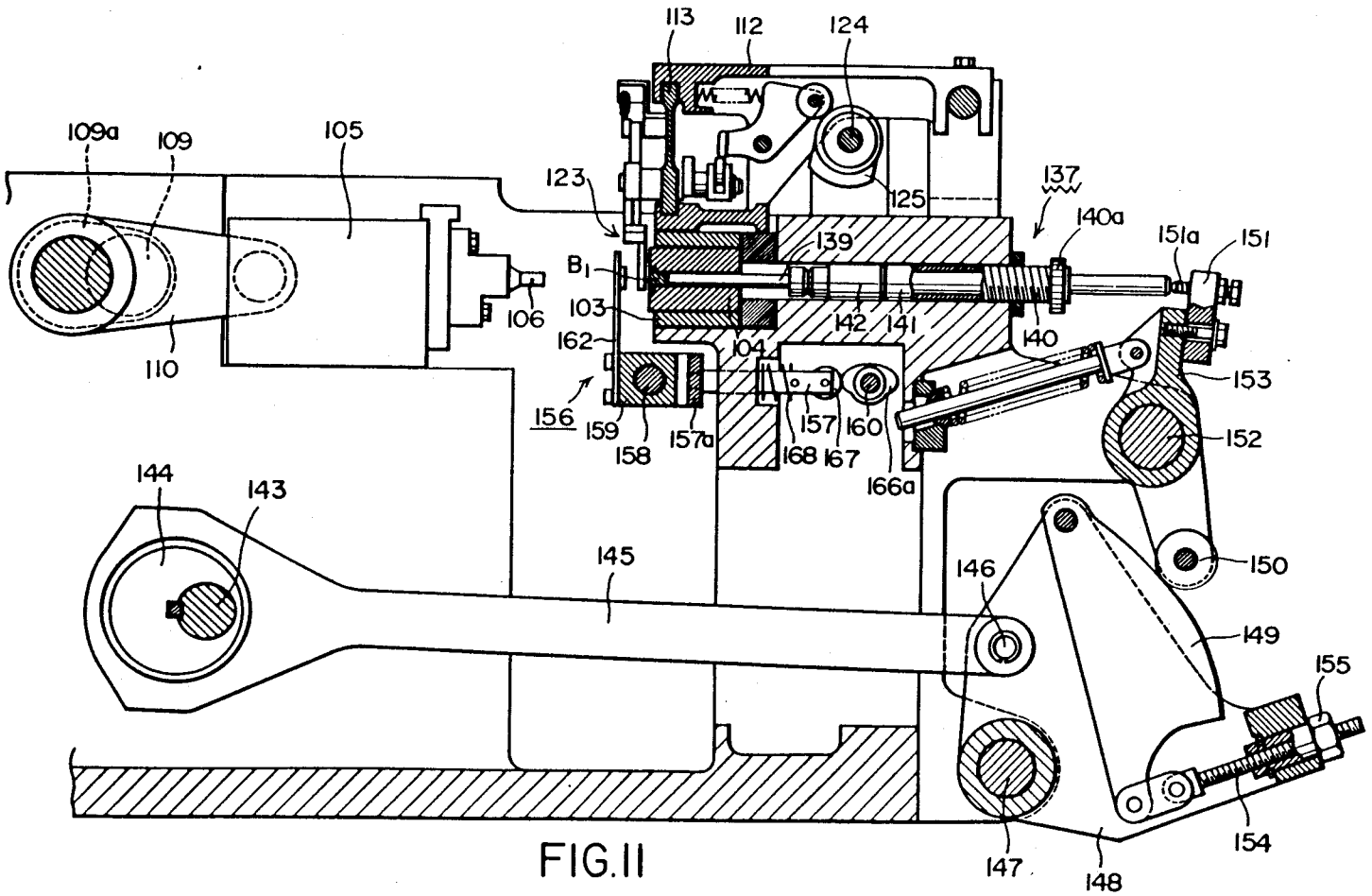
FIG. 11 is a front view on an larger scale showing a modified version of the parts forming aid unit according to the present invention.

Referring to FIG. 11, a further modified parts forming aid unit 156 will be described:

The modified aid unit 156 is designed to retain a blank $B_1$ between a knockout pin 139 and an aid pin 162, wherein the aid pins are moved in parallel with the row of the dies with the minimum gap between the blank and the aid pins, thereby securing the blank between the knockout pin and the aid pin before it completely comes out of the die. This prevents blanks having short shanks from slipping off the dies.

The knockout unit 137 includes a knockout pin 139, a sleeve 140, a pushin rod 141 slidably housed in the sleeve 140, and an intermediate pin 142. The knockout unit 137 is driven by a knockout driving unit 138, which comprises an eccentric main shaft 143 connected to a ram driving crankshaft 190 through a suitable gearing (not shown), an eccentric wheel 144 fixed to the main shaft 143, a connecting rod 145 whose end is fixed to the wheel 144 with the other end being connected to a rocking lever 148 by means of a pivot 146, the rocking lever 148 being rocked by a main shaft 147, and a rocker 153 having a roller 150 kept in contact with a cam 149 supported by the rocking lever 148, the rocker 153 being kept in contact with a tail end of the pushing rod 141 through a pin 151*a* of a knocker 151.

When the crankshaft 190 (which corresponds to the crankshaft 9 in the above-mentioned embodiments shown in FIGS. 1 to 10) is rotated to drive the ram 5, the rocking lever 148 starts to rock around the main shaft 147 in a predetermined angular range. As a result, the rocker 153 rocks to cause the knocker 151 to press the pushing rod 141 by its pin 151*a*. The blank $B_1$ in the die 141 is pushed out of the die with the hammer withdrawing.

The size of the die cavity can be adjusted by determining the position of the knockout pin 139 in the die. The position of the knockout pin 139 is determined by rotating a gear 140*a* so as to advance or retreat the sleeve 140. In this case, it is necessary to adjust the position of the cam 149 with respect to the rocking lever 148 by rotating a nut 155 fastened to a screw 54, thereby determining the rocking range of the rocker 153.

Figure 12:
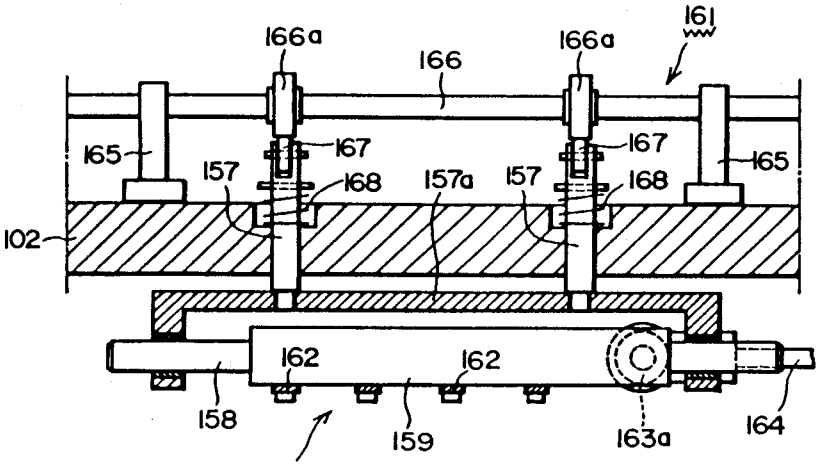
FIG. 12 is a cross-sectional plan view showing a part of the aid unit of FIG. 11.

Referring to FIG. 12, the aid unit 158 includes a pair of shafts 157 passed through a bed 102 under the die block 103, the shafts 157 being secured to a supporting frame 157*a* carried on a shaft 158 fixed to a block 159, a first driving means (FIG. 11) which causes the block 159 to reciprocally move along the shaft 158, a second driving means (FIG. 12) which causes the block 159 to move to and from the dies 140, and a plurality of aid pins 162 adapted to hold the blank $B_1$ against the knockout pin 139. The first driving means 160 includes an intermediate rod 164 whose end is connected to the block 159 through a joint 163*a* with the other end being connected to a chuck driving shaft 115 through a joint 163*b*. The second driving means 161 comprises a cam driving shaft 166 carried on a pair of brackets 165, cams 166*a* fixed to the cam driving shaft 166, rollers 167*a* rotatively carried on the shafts 157 so as to be kept in contact with the respective cams 166*a*, and springs 168 for normally biasing the shafts 157 toward the bed 102. The rotation of the cams 188*a* causes the shafts 157 to move away from the bed 102, but the springs 168 force them back, thereby enabling the block 159 to move to and from the bed 102. In this way the aid pins 162 fixed to the block 159 to move to and from the dies.

Figure 13I:
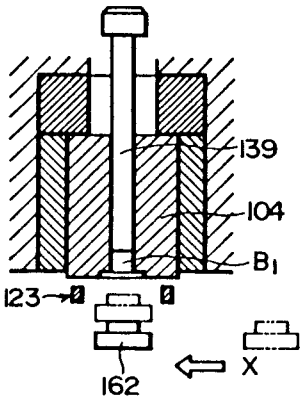
FIGS. 13(I), (II) and (III) are schematic views showing the relationship among the knockout pin, the chuck, the aid pin, and the blank in the example of FIG. 11.
Figure 13:
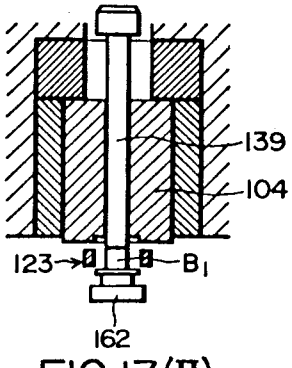

In operation, while the ram is withdrawn to allow the hammers to retreat from the dies, the chucks are opened and moved in the direction of arrow (X) in FIG. 2 by the chuck driving shaft until they position in front of the dies. At this moment the block 159 is moved such that the aid pins 162 are moved in the direction of (X) in FIG. 13(I) until they position in front of the respective dies 140. Then the springs 168 force the block 159 toward the bed 102. As a result, the aid pins advance toward the respective dies from the position indicated by a full line to the position indicated by a chain line in FIG. 13(I). At this stage, as shown in FIG. 13(II) the blank $B_1$ is pushed out of the die by the knockout pin 139, and is clamped between the knockout pin 139 and the aid pins 162 before the blank completely comes out of the die. This is of particular advantage when the blank $B_1$ is as thin as a disc, otherwise it would easily slip out of the die. The aid pins 162 are withdrawn against the springs 168, and the blank $B_1$ is clamped by the chuck 123 as shown in FIG. 13(III). The withdrawal of the aid pins 162 takes place under the action of the cams 166*a*. The blank $B_1$ is transferred to the next die (i.e. the next forging stage). Owing to the withdrawal of the aid pins, a possible collision between the hammers and the aid pins is avoided.

Figure 14:
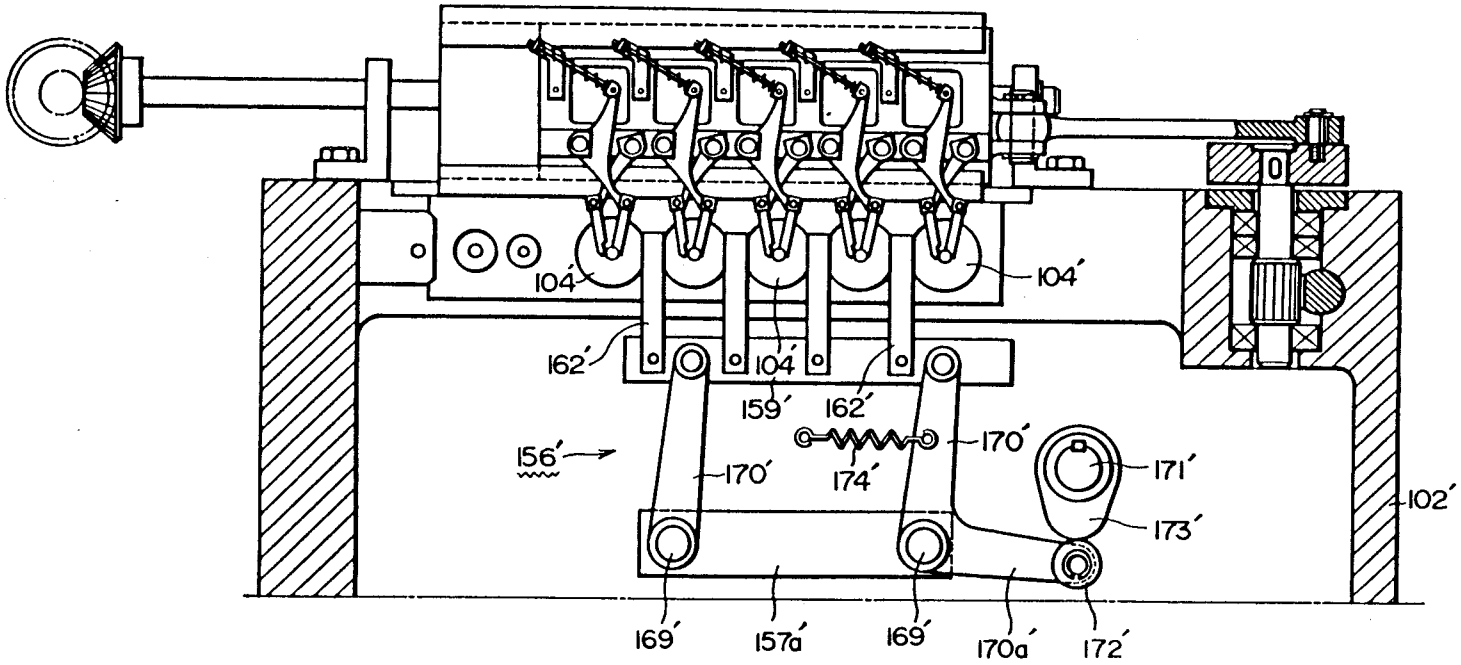
FIG. 14 is a front view showing a further modified example of the embodiment according to the present invention.
Figure 17:
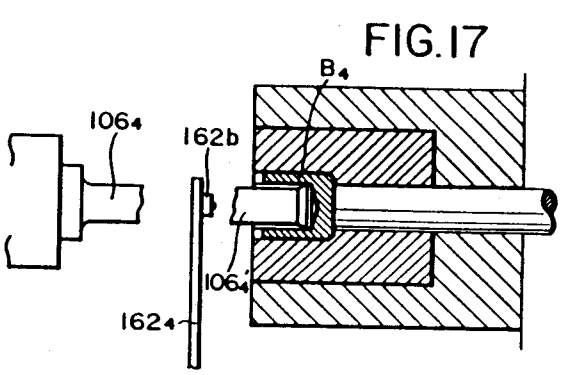
FIGS. 15 to 18 are schematic views showing various examples of application of the aid unit according to the present invention.

FIG. 14 shows a modification to the embodiment of FIG. 11. The modified version 156' comprises a pair of rocking levers 170'. One lever 170' has an extension 170*a'* which is provided with a roller 172' kept in contact with a cam 173', and is connected to the bed 102' by a spring 174'. The rocking levers 170' support a block 159', which carries a plurality of aid pins 162'. When the cam 173' is rotated, the block 159' is moved to the right and the left in FIG. 14, thereby enabling the aid pins 162' to move by the distance between one die and the next. At this moment the block 159' is moved toward and from the dies by the second driving means 161.

Figure 15:
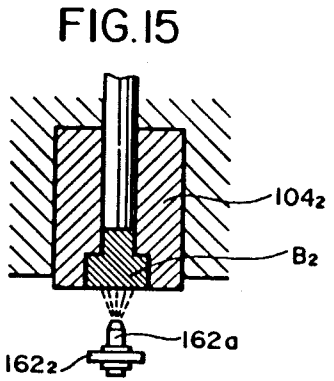
Figure 18:
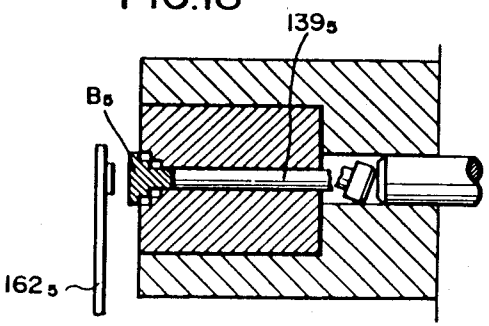
Figure 16:
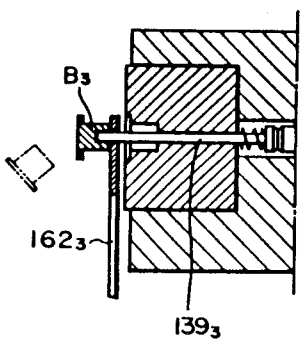
Figure 16I:
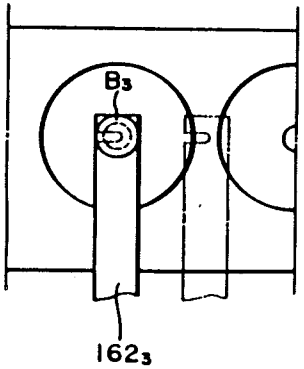

FIGS. 15 to 18 show various examples of application. FIG. 15 shows the same example as described above with reference to FIG. 7. FIGS. 16(I) and 16(II) show an example in which a bore is produced in the blank $B_3$ by the knockout pin $139_3$. The aid pin $162_3$ is inserted in between the end face of the blank $B_3$ and the die face, and as the knockout pin is withdrawn, the blank $B_3$ is easily released from the die as indicated in FIG. 16(II). FIG. 18 shows an example in which a bore is produced in the blank $B_4$ by the hammer $106_4$. In this case, the top portion of the hammer is sometimes broken, and the broken piece $106_4'$ is left in the die. The aid pin $162_4$ is provided with a sensor 162*b* which detects the presence of the broken piece $106_4'$ in the die and signals to the drive section so as to suspend the operation of the machine immediately. FIG. 18 shows an example in which the aid pins $162_5$ and the knockout pin $139_5$ are electrically connected to each other through the blank $B_5$. If the knockout pin is broken, the electrical conductivity will be interrupted, which is detected so as to suspend the operation of the machine.

What is claimed is:

1. A multi-stage cold forging machine having a plurality of forging stages through which a metal blank is transferred and progressively refined, the machine comprising:

a die block having a plurality of dies spaced at equal intervals to form a row of dies;

a ram carrying a number of hammers corresponding to that of the dies, the ram being reciprocally moved to and from the die block, the ram being power driven through a crankshaft;

a chuck block carrying a number of chucks corresponding to that of the dies, the chucks being adapted to clamp a forged blank and transfer it to the next stage, the chuck block being reciprocally moved along the row of dies;

a chuck driving shaft for moving the chuck block reciprocally by a distance between adjacent dies, thereby enabling the chucks to transfer a clamped blank between adjacent dies, the chuck driving shaft being rotated by the ram driving crankshaft;

a chuck operating shaft for opening and closing the chucks synchronously with the advance and withdrawal of the ram, the chuck operating shaft being connected to the ram driving crankshaft; and a parts forming aid unit having a plurality of pins for aiding one of the chucks to engage a blank to be removed from one of the plurality of dies and for inserting a blank into one of the plurality of dies after release by one of the chucks, wherein the aid unit comprises a sliding block slideably and rotatively carried on a shaft extending along the row of the dies, a driving means for moving the sliding block along the shaft by the distance between adjacent dies between an initial position with at least one of the pins positioned between adjacent dies and a final position with pins in front of a respective die, synchronously with the rotation of the chuck driving shaft so that the pins are reciprocally moved between the initial and final positions with the pins out of the way of hammers of the ram as the ram is moved towards the die block, and a rocking unit for rotating the sliding block about the shaft to synchronously move the pins toward and away from the dies through the operation of a cam effected by the rotation of the chuck operating shaft so that the pins protrude toward the dies and retain a blank therefrom until it is clamped by the respective chucks for removal and insert a blank into one of the plurality of dies after transfer and release by one of the chucks when the sliding block is positioned in the final position.

* * * * *